US006098728A

United States Patent [19]

Wells et al.

[11] Patent Number: 6,098,728

[45] Date of Patent: Aug. 8, 2000

[54] ROCK BIT NOZZLE ARRANGEMENT

[75] Inventors: Jennifer Ann Wells; Wayne Lee Baker, both of The Woodlands; Christopher Steven Charles, Houston; James Lynn Duggan, Friendswood; Thomas John Gottschalk, Houston; Timothy King Marvel, The Woodlands; Daniel Edward Ruff, Kingwood; Troy Richard Stuart, Stafford, all of Tex.

[73] Assignee: Baker Hughes Incorporated, Houston, Tex.

[21] Appl. No.: 09/049,523

[22] Filed: Mar. 27, 1998

[51] Int. Cl.[7] ..... E21B 10/18

[52] U.S. Cl. ..... 175/340; 175/393

[58] Field of Search ..... 175/340, 393, 175/424

[56] References Cited

U.S. PATENT DOCUMENTS

| | | | |
|---|---|---|---|
| 930,759 | 8/1909 | Hughes . | |
| 1,388,490 | 8/1921 | Suman . | |
| 1,480,014 | 1/1924 | Scott . | |
| 1,647,753 | 11/1927 | Scott et al. . | |
| 1,983,316 | 12/1934 | Scott et al. . | |
| 2,104,823 | 1/1938 | Sherman . | |
| 2,192,693 | 3/1940 | Payne . | |
| 2,333,746 | 11/1943 | Scott et al. . | |
| 2,644,671 | 7/1953 | Ingram | 175/340 |
| 2,815,936 | 12/1957 | Peter et al. . | |
| 3,014,544 | 12/1961 | Steen . | |
| 3,144,087 | 8/1964 | Williams, Jr. . | |
| 3,363,706 | 1/1968 | Feenstra . | |
| 3,688,853 | 9/1972 | Maurer et al. | 175/340 |
| 3,923,109 | 12/1975 | Williams, Jr. | 175/340 |
| 4,222,447 | 9/1980 | Cholet | 175/340 |
| 4,369,849 | 1/1983 | Parrish | 175/340 |
| 4,516,642 | 5/1985 | Childers et al. | 175/340 |
| 4,546,837 | 10/1985 | Childers et al. | 175/340 |
| 4,558,754 | 12/1985 | Childers et al. | 175/340 |
| 4,582,149 | 4/1986 | Slaughter, Jr. | 175/340 |
| 4,611,673 | 9/1986 | Childers et al. | 175/340 |
| 4,739,845 | 4/1988 | Dennis | 175/340 |
| 4,776,412 | 10/1988 | Thompson | 175/393 |
| 4,794,995 | 1/1989 | Matson et al. | 175/393 |
| 4,878,548 | 11/1989 | Ostertag et al. | 175/340 |
| 4,984,643 | 1/1991 | Isbell et al. | 175/341 |
| 5,096,005 | 3/1992 | Ivie et al. | 175/340 |
| 5,669,459 | 9/1997 | Larsen et al. | 175/340 |
| 5,791,417 | 8/1998 | Haugen et al. | 166/298 |
| 5,887,655 | 3/1999 | Haugen et al. | 166/298 |

FOREIGN PATENT DOCUMENTS

| | | | |
|---|---|---|---|
| 737797 | 10/1996 | European Pat. Off. . | |
| 1620585 | 5/1983 | U.S.S.R. . | |
| 1620585 | 1/1991 | U.S.S.R. | 15/340 |

OTHER PUBLICATIONS

Feenstra, R., "Full–Scale Experiments on Jets in Impermeable Rock Drilling", *Journal of Petroleum Technonology,* Mar. 1964, pp. 329–336.

Feenstra et al., "Full–Scale Experiments on Jets in Impermeable Rock Drilling," Journal of Petroleum Technology, pp. 329–336 (1964).

*Primary Examiner*—William Neuder

*Attorney, Agent, or Firm*—Duane, Morris & Heckscher LLP

[57] ABSTRACT

A drillbit with a flexible nozzle system is provided to address bit- and bottom-balling situations. In one embodiment, a given nozzle can have an mounting member which is oblong or another shape so as to be installable into different positions where, in one position, the bit-balling problem is addressed, while in the other, the bottom-balling problem is addressed. Other shapes that provide this flexibility can also be employed. The nozzle body can also be made with a symmetrical mount, with the outlet askew such that the symmetrical mount, when placed in a strategically located nozzle opening, can address bit- or bottom-balling situations by a simple reversal of the orientation where multiple orientations are available for the base. Alternatively, in the area between adjacent cones, multiple nozzle installations can be provided to independently address the bit-balling and bottom-balling situations between adjacent cones. In any given bit, individual nozzles to address bit- or bottom-balling can be mounted between different pairs of cones so as to be able to address both problems in a bit body design that only provides for a single nozzle outlet between each of the cones.

30 Claims, 6 Drawing Sheets

ROCK BIT NOZZLE ARRANGEMENT

FIELD OF THE INVENTION

The field of this invention relates to earth-boring bits used in the oil, gas and mining industries, especially those having nozzle arrangements to prevent the cutter teeth from "balling up" with compacted cuttings from the earth and/or to keep the bottom of the borehole from "balling up."

BACKGROUND OF THE INVENTION

Howard R. Hughes invented a drill bit with rolling cones used for drilling oil and gas wells, calling it a "rock bit" because it drilled from the outset with astonishing ease through the hard caprock that overlaid the producing formation in the Spindletop Field near Beaumont, Tex. His bit was an instant success, said by some the most important invention that made rotary drilling for oil and gas commercially feasible the world over (U.S. Pat. No. 930,759, "Drill," Aug. 10, 1909). More than any other, this invention transformed the economies of Texas and the United States into energy-producing giants. But his invention was not perfect.

While Mr. Hughes' bit demolished rock with impressive speed, it struggled in the soft formations such as the shales around Beaumont and in the Gulf Coast of the United States. Shale cuttings sometimes compacted between the teeth of the "Hughes" bit until it could no longer penetrate the earth. When pulled to the surface, the bit was often, as the drillers said, "balled up" with shale—sometimes until the cutters could no longer turn. Even moderate balling up slowed the drilling rate and caused generations of concern within Hughes' and his competitors' engineering organizations.

Creative and laborious efforts ensued for decades to solve the problem of bits "balling up" in the softer formations, as reflected in the prior art patents. Impressive improvements resulted, including a bit with interfifting or intermeshing teeth in which circumferential rows of teeth on one cutter rotate through opposed circumferential grooves, and between rows of teeth, on another cutter. It provided open spaces on both sides of the inner row teeth and on the inside of the heel teeth. Material generated between the teeth was displaced into the open grooves, which were cleaned by the intermeshing rows of teeth. It was said, and demonstrated during drilling, " . . . the teeth will act to clear each other of adhering material." (Scott, U.S. Pat. No. 1,480,014, "Self-Cleaning Roller Drill," Jan. 8, 1924.) This invention led to a two-cone bit made bye " . . . cutting the teeth in circumferential rows spaced widely apart . . . " This bit included " . . . a series of long sharp chisels which do not dull for long period." The cutters were true rolling cones with intermeshing rows of teeth, and one cutter lacked a heel row. The self-cleaning effect of intermeshing thus extended across the entire bit, a feature that would resist the tendency of the teeth becoming balled up in soft formations. (Scott U.S. Pat. No. 1,647,753, "Drill Cutter," Nov. 1, 1927.)

Interfitting teeth are shown for the first time on a three-cone bit in U.S. Pat. No. 1,983,316, the most significant improvement being the width of the grooves between teeth, which were twice as wide as those on the two-cone structure without increasing uncut bottom. This design also combines narrow interfitting inner row teeth with wide noninterfitting heel rows.

A further improvement in the design is shown in U.S. Pat. No. 2,333,746, in which the longest heel teeth were partially deleted, a feature that decreased balling and enhanced penetration rate. A refinement of the design was the replacement of the narrow inner teeth with fewer wide teeth, which again improved performance in shale drilling.

By now the basic design of the three-cone bit was set (1) all cones had intermeshing inner rows, (2) the first cone had a heel row and a wide space or groove equivalent to the width of two rows between it and the first inner row with intermeshing teeth to keep it clean, (3) a second cone had a heel row and a narrow space or groove equivalent to the width of a single row between it and the first inner heel without intermeshing teeth, and (4) a third cone had a heel and first inner row in a closely spaced, staggered arrangement. A short-coming of this design is the fact that it still leaves a relatively large portion of the cutting structure out of intermesh and subject to balling.

Another technique of cleaning the teeth of cuttings involved flushing drilling fluid or mud directly against the cutters and teeth from nozzles in the bit body. Attention focused on the best pattern of nozzles and the direction of impingement of fluid against the teeth. Here, divergent views appeared, one inventor wanting fluid from the nozzles to " . . . discharge in a direction approximately parallel with the taper of the cone" (Sherman U.S. Pat. No. 2,104,823, "Cutter Flushing Device," Jan. 11, 1938), while another wanted drilling fluid discharged " . . . approximately perpendicular to the base [heel] teeth of the cutter." (Payne, U.S. Pat. No. 2,192,693, "Wash Pipe." Mar. 5, 1940.)

A development concluded after World War II seemed for awhile to solve completely the old and recurrent problem of bit balling. A joint research effort of Humble Oil & Refining Co. and Hughes Tool Co. resulted in the "jet" bit. This bit was designed for use with high-pressure pumps and bits with nozzles (or jets) that pointed high-velocity drilling fluid between the cones and directly against the borehole bottom, with energy seemingly sufficient to quickly disperse shale cuttings, and simultaneously, keep the cutters from balling up because of the resulting highly turbulent flow condition between the cones. This development not only contributed to the reduction of bit balling, but also addressed another important phenomenon which became later known as chip holddown.

Early rolling cutter bits used drilling fluid to clean the cones. Low-velocity fluid was directed onto the cones through relatively large drilled-water-course holes. In 1948, Nolley et al. reported on a new rolling cutter bit in which the drilling fluid was accelerated through nozzle orifices. This high-velocity fluid stream was purposely aimed at the hole bottom, away from the cones, to clean the bottom and to avoid cone erosion. While drilling hard shale in the Mallalieu Field in Mississippi, this bit drilled 68 to 118 percent faster than the previous drilled-water-course bits. This jet bit soon found widespread application. Beilstein et al. documented benefits of jetting hydraulic fluid on the bottom of the borehole. This nozzle orientation, aimed at the hole bottom near the corner of the borehole, more or less equidistant between the cones, became the industry standard. Today, this nozzle arrangement is referred to as a conventional nozzle. Conventional nozzle size and placement was optimized over many years through studies on the effects of hydraulic horsepower, jet impact force and nozzle distance off bottom in a variety of rock types under in-situ stress states.

From almost the beginning, Hughes and his engineers recognized variances between the drilling phenomena experienced under atmospheric condition and those encountered deep in the earth. Rock at the bottom of a borehole is much more difficult to drill than the same rock brought to the surface of the earth. Model-sized drilling simulators showed in the 1950's that removal of cuttings from the borehole bottom is impeded by the formation of a filter cake on the borehole bottom. "Laboratory Study of Effect Of Overburden, Formation And Mud Column Pressures On Drilling Rate Of Permeable Formation," R. A. Cunningham and J. F. Eenick, presented at the 33rd Annual Fall Meeting of the S.P.E., Houston, Tex., October 508, 1958. While a filter cake formed from drilling mud is beneficial and essential in preventing sloughing of the wall of the hole, it also reduces drilling efficiencies. If there is a large difference between the borehole and formation pressure, also known as overbalance or differential pressure, this layer of mud mixes cuttings and fines from the bottom and forms a strong mesh-like layer between the cutter and the formation, which keeps the cutter teeth from reaching virgin rock. The problem is accentuated in deeper holes since both the mud weights and hydrostatic pressure are inherently higher. One approach to overcome this perplexing problem is the use of ever higher jet velocities in an attempt to blast through the filter cake and dislodge cuttings so they may be flushed through the wellbore to the surface.

The filter cake problem and the balling problem are distinct since filter cake build-up, also known as "bottom balling," occurs mainly at greater depth with weighted muds, while cutting structure balling is more typical at shallow depths in more highly reactive shales. Yet these problems can overlap in the same well since various formations and long distances must be drilled by the same bit. Inventors have not always made clear which of these problems they are addressing, at least not in their patents. However, a successful jet arrangement must deal with both problems; it must clean the cones but also impinge on bottom to overcome bottom balling.

In 1964, Feenstra and Van Leeuwen distinguished between what they termed "bit balling" and "bottom balling." They defined bit balling as powdered rock material which sticks to the teeth of the bit. When the rock material builds up on the cone to a thick layer, it absorbs a portion of the bit weight and prevents the bit teeth from penetrating uncut rock. This is most commonly observed when drilling in sticky shales, but has also been reported to occur in schist. They defined bottom balling as a layer of pulverized rock material covering the borehole bottom, making a plastic and pliable interface between the drill bit and virgin formation, preventing the teeth from cutting virgin rock. This phenomenon has since been shown to occur in a wide variety of rocks. In permeable rocks, this phenomenon is most pronounced and is referred to as chip holddown. Bottom balling also occurs in low-permeability rocks and some shales in which the clay particles tend to stick to each other rather than the bit. Feenstra and Van Leeuwen refer to this as dynamic chip holddown. Bottom balling is a function of borehole pressure and may be the predominant balling mode in shale and mudstone at great depth. Feenstra and Van Leeuwen recommended directing nozzles at cones to combat bit balling and directing nozzles at the borehole bottom to combat bottom balling.

The direction of the jet stream and the area of impact on the cutters and borehole bottom receives periodic attention of inventors. Some interesting, if unsuccessful, approaches are disclosed in the patents. One patent provides a bit that discharges a tangential jet that sweeps into the bottom comer of the hole, follows a radial jet, and includes an upwardly directed jet to better sweep cuttings up the borehole. (Williams, Jr., U.S. Pat. No. 3,144,087, "Drill Bit With Tangential Jet," Aug. 11, 1964.) The cutters have an unusual tooth arrangement, including one with no heel row of teeth, and two of the cutters do not engage the wall of the borehole. One nozzle extends through the center of the cutter and bearing shaft and another exits at the bottom of the "leg" of the bit body, near the corner of the borehole.

There is some advantage to placing the nozzles as close as possible to the bottom of the borehole. (Feenstra, U.S. Pat. No. 3,363,706, "Bit With Extended Jet Nozzles," Jan. 16, 1968.) The prior art also shows examples of efforts to orient the jet stream from the nozzles such that they partially or tangentially strike the cutters and then the borehole bottom at an angle ahead of the cutters. (Childers, et al., U.S. Pat. No. 4,516,642, "Drill Bit Having Angled Nozzles For Improved Bit and Wellbore Cleaning," May 14, 1985.)

In 1984, Slaughter reported on a new bit, which implemented Feenstra and Van Leeuwen's recommendation for bit-balling situations. On this bit, each of the three jets are aimed such that they skim the leading edge of the cone and then impinged on the bottom. Slaughter reported an increase in ROP of up to 27% over convention nozzle bits in field tests. In 1992, Moffitt et al. describe tests in which a variety of nozzle targets in the neighborhood of Slaughter's original directed nozzle were evaluated. A more optimum nozzle target was selected and developed which yielded up to 50% increase in ROP over convention bit nozzles in field applications.

A more recent approach to the problem of bit balling is disclosed in the patent to Isbell and Pessier, U.S. Pat. No. 4,984,643, "Anti-Balling Earth-Boring Bit," Jan. 15, 1991. Here, a nozzle directs a jet stream of drilling fluid with a high-velocity core past the cone and inserts of adjacent cutters to the borehole bottom to break up the filter cake, while a lower velocity skirt strikes the material packed between the inserts of adjacent cones. The high-velocity core passes equidistant between a pair of cutters, and the fluid within the skirt engages each cutter in equal amounts. While significant improvement was noted in reducing bit and bottom balling, the problem persists under some drilling conditions.

In spite of the extensive efforts of inventors laboring in the rock bit art since 1909, including those of the earliest, Howard R. Hughes, the ancient problem of rock bits "balling up" persists. The solutions of the past prevent balling in many drilling environments, and the bit that balls up so badly that the cutters will no longer turn is a species of the problem that has all but completely disappeared. Now, the problem is much more subtle and often escapes detection. It only occurs in the downhole environment and thus is largely unappreciated as a cause of poor drilling performance in the field. Simulation has allowed duplication of that environment and thus led to substantial refinements and improvements of earlier designs.

There are two main bit nozzle classifications. In the first classification are bits in which a conventional nozzle impinges the fluid stream directly on the borehole bottom. The second classification includes bits with nozzles aimed such that they strike some portion of the cone, to clean it, before they strike the borehole bottom, known as "directed nozzles." There are differences in performance between bits with conventional nozzles versus bits with directed nozzles in bit and bottom balling applications. Bits with conventional nozzles are superior in bottom-balling applications, and directed nozzle bits are superior in bit-balling applications.

The nozzle orientation strategy of one type of directed nozzle bits is closely bound up with bit geometry features that result from cone "offset." Some bit manufacturers refer to this same feature as cone "skew angle." The axis of cone bearings of soft formation bits typically does not pass through the center of the borehole. It is offset in the direction of rotation. Because of cone offset, the gage cutting elements of a cone cut gage only on the leading side of the cone. On the trailing side of the cone, the gage cutting elements move away from the gage, creating a "bit offset space" between them and the hole wall.

Compared to a conventional nozzle, the nozzle orifice of this type of directed nozzle is moved circumferentially outward toward the wall of the hole and radially toward the trailing side of the adjacent cone. The fluid stream exits the nozzle at a point closer to the wall, and is oriented more vertically and travels more parallel to the wall than either the conventional nozzle or the other directed nozzle bits. The fluid stream is aimed at the bit offset space. The core of the nozzle skims the cone gage surface, cleaning the gage-cutting elements. It passes through the bit offset space, between the cone and the hole wall, and impinges the borehole at the intersection of the hole wall and hole bottom. After impinging In the corner of the borehole, the borehole wall directs the fluid inward, where it flows through the Interstices of the gage-cutting teeth and over the surface of the cone.

In field applications where bit balling is dominant, bits with directed nozzles typically outperform bits with conventional nozzles. However, in areas where bit balling is not dominant, bits with conventional nozzles often drill faster than directed nozzle bits.

The fact that directed nozzles excel in bit-balling applications and conventional nozzles excel in bottom-balling applications presented opportunities to improve performance by correct selection of nozzle arrangement for a given field application. A hybrid nozzle arrangement was developed which, it was hoped, would allow the bit to clean optimally in either type of balling. A bit which had one conventional nozzle and two directed nozzles was tried. This was implemented on a cutting structure which has a heel arrangement on one cone called an anti-balling heel. The term "heel" refers to the outer-most row of teeth on the face of the bit, which cuts gage. The heel row on this one cone experiences less balling than standard heels. Therefore, the conventional nozzle was placed on this leg, while the directed nozzles were aimed at the other two legs, which had standard heel rows. It was hoped that the one conventional nozzle would be sufficient to clean the bottom, in bottom-balling applications, and the two directed nozzles would be sufficient to clean the cones in bit-balling applications and as a result, this bit would approach optimal performance in both environments.

The rate of penetration ("ROP") of the hybrid bit in these tests was faster than the directed nozzle bit in Catoosa shale, indicating that the one conventional nozzle was effecting some cleaning of the bottom. However, the hybrid bit never achieved an ROP in Catoosa as high as the bit with three conventional nozzles, indicating that the one nozzle aimed at bottom did not clean as efficiently as the three nozzles of a conventional bit. The hybrid bit was slower in Mancos shale than the bit with three directed nozzles. An increase in bit balling was observed on the cone adjacent to the conventional nozzle, especially on the inner rows.

Thus, the performance of this hybrid bit fell in between the directed nozzle bits and conventional nozzle bits. It was more of a compromise in each environment than an optimal solution in each.

The selection of an appropriate nozzle arrangement for any given field application depends on whether bit balling or bottom balling is the predominant in that application. Many studies have been conducted in an effort to determine what shale and mud properties cause balling. No consensus has yet been reached and it is not possible to predict whether a shale will cause balling or not. It is even less possible to distinguish a priori whether a particular shale and mud combination will cause bit balling or bottom balling.

However, it is possible to distinguish bit and bottom balling in practice through a drill-off test because bit balling and bottom balling have different ROP responses to increasing bit weight. When bit-balling tendencies are present, increasing weight on bit will result in increasing ROP only to a point, referred to as the flounder point. At this point, cuttings pack in between the teeth and absorb bit weight, preventing the teeth from cutting virgin formation. Increasing bit weight after the flounder point has been reached does not increase ROP. However, when bottom balling occurs, a flounder point is not observed and ROP continues to increase with increasing bit weight. The reason for the difference in ROP response to weight is that in bottom-balling situations, balled material can extrude into the spaces between the cones; however, in a bit-balling situation, the compacted material is confined in spaces between the teeth and borehole wall and bottom and cannot extrude.

Thus, a bit with directed nozzles is the best choice for drilling applications which exhibit a flounder point, and a bit with conventional nozzles is the best choice for drilling applications which do not exhibit a flounder point.

Cone erosion is another factor that dictates nozzle choice. Since bits with directed nozzles expend a portion of their hydraulic energy on the cones, they may erode the steel bodies of the cones, eventually leading to loss of carbide or steel teeth. Circumstances which cause cone erosion include a high sand content in the mud and high hydraulic horsepower.

When drilling in areas with a high sand content, the abrasive sand particles may cause excessive cone erosion on directed nozzle bits. However, areas with high sand content are typically not areas in which bit balling is prevalent. Thus, the best choice of bit for areas with a high sand content is the conventional nozzle bit. In these areas, directed nozzles are not needed to clean the cones and, in fact, directed nozzles may be a liability due to cone erosion.

It has been observed that the benefit of directed nozzle bits over conventional nozzle bits diminishes with increasing HSI. Furthermore, a high HSI can lead to cone erosion on directed nozzle bits. These two facts make the conventional nozzle bit a better choice than a directed nozzle bit at high HSI levels. Cone erosion can become a problem at or above 150 horsepower per cone in areas where sand content is low. Where sand content is high, erosion may occur as low as 80 horsepower per cone. Cone erosion may be particularly critical when a blank nozzle is run in a bit since the horsepower levels of the jets in the two remaining nozzles may exceed these limits. If a directed nozzle bit needs to be run and cone erosion is likely to occur, the cones may be coated with a carbide coating which eliminates cone erosion due to fluid impact.

Laboratory tests of bits in situations with bit balling and bottom balling have shown that there are different optimal nozzle configurations for each of these situations. Bits with directed nozzles have higher ROP in bit-balling situations. Bits with conventional nozzles have higher ROP in bottom-balling situations. These results are consistent with field observations.

In field applications, the presence of a flounder point is indicative of bit balling. In these cases, bits with directed nozzles should be used. When a flounder point is not observed, bits with conventional nozzles should be used.

Potential cone erosion is also a factor to be considered in deciding between bits with directed nozzles and conventional nozzles. If sand content is high, bit balling is most likely not prevalent and bits with conventional nozzles should be used. When hydraulic horsepower per cone exceeds certain limits, erosion may occur. If cone erosion is excessive, erosion-resistant cone coatings may be used.

What has heretofore been lacking is a bit which can flexibly accept directed and conventional nozzles interchangeably or simultaneously so that when a given situation of bit or bottom balling is expected or encountered, a bit can be easily configured prior to delivery to a field site or even by personnel at the rig site so that maximum ROP is obtained. This is one of the objects of the present invention.

Patents and literature describes various nozzle configurations, including U.S. Pat. Nos. 5,096,005; 4,516,642; 4,546,8347; 4,558,754; 4,582,149; 4,878,548; 4,794,995; 4,776,412, and 1,388,490; and Feenstra, R., and J. J. M. Van Leeuwen, "Full-Scale Experiments on Jets in Impermeable Rock Drilling," *Journal of Petroleum Technology*, Mar. 1964, pp. 329–336.

Recently, the Hughes Christensen division of Baker Hughes has introduced the HydraBoss line of bits where the nozzles are moved adjacent one of the cones, and their central axes are oriented in such a way that the stream from such nozzles passes adjacent the rolling cone to minimize the effect of bit balling.

A difficulty that is encountered is that when bits are manufactured, it is not known in what service they will ultimately be employed and, therefore, the past designs, which have nozzle systems oriented toward addressing either one of the two problems of bit balling or bottom balling, can have difficulty in rate of penetration when the other problem occurs and the nozzles are not oriented to address it. Accordingly, one of the objects of the present invention is to provide a bit design primarily for a roller cone bit where the design allows for flexibility in orientation of one or more of the nozzles to address, in a given bit, not only one of the two issues of bit balling or bottom balling, but both. Additionally, this flexibility is to be provided in the manner that allows the most efficient use of the fluid energy available for either addressing the bit-balling or bottom-balling situation. Another objective of the present invention is to allow, between each pair of roller cones, the ability to address one or both of these problems in an individual bit.

One of the solutions that has been attempted in the past with limited success is the use of a tilted nozzle, as shown in FIG. 2. The tilted nozzle was employed to address the bit-balling problem where the standard nozzle location was being used for installation of the tilted nozzle shown in FIG. 2. The idea was to address the bit-balling situation without modifying the existing bit body. The problem which arose occurred due to the placement of the standard nozzle opening between two adjacent cones, which traditionally functioned to accept conventional nozzles oriented to deal with bottom balling. To address the bottom-balling situation, the conventional nozzle location was approximately mid-way between two adjacent roller cones. The idea in the past was to take the tilted nozzle, which has a nozzle bore which, at its outlet end, is misaligned with the center axis of the nozzle body, and turn the nozzle in such a manner so as to point the stream toward the cone to address the bit-balling situation. A disadvantage of this design was that a greater distance had to be traversed by the nozzle stream to reach the cone area from the standard nozzle mount in the bit body, where the nozzle mount is oriented for addressing bottom-balling situations. Thus, the incrementally greater distance with an offset bore in the nozzle, as indicated in FIG. 2, reduced the available energy in the nozzle stream to remove cuttings, as well as dissipated the fluid energy since the fluid was forced to turn within the nozzle prior to exiting into the borehole for fulfilling its cleaning function. The tilted nozzle gave the operator some flexibility in adapting a bit for a particular function. In using the tilted nozzle, the customer could select not only different orifice sizes, but also the direction of the flow could be changed. However, the optimum in addressing the bit- and/or bottom-balling situations could not be achieved with the tilted nozzle design because of the drawbacks of its physical positioning, as well as the attendant energy losses due to directional changes within the nozzle body. Accordingly, it is another object of the present invention to allow nozzle mounting systems that can convert in a given bit to address bit- or bottom-balling situations, while at the same time optimizing the energy and placement of the fluid stream so as to more efficiently accomplish one or the other functions from a given nozzle. These and other objectives of the present invention will become more apparent to those of ordinary skill in the art from a review of the detailed description of the preferred embodiment below.

SUMMARY OF THE INVENTION

A drillbit with a flexible nozzle system is provided to address bit- and bottom-balling situations. In one embodiment, a given nozzle can have a mounting member which is oblong or another shape so as to be installable into different positions where, in one position, the bit-balling problem is addressed, while in the other, the bottom-balling problem is addressed. Other shapes that provide this flexibility can also be employed. The nozzle body can also be made with a symmetrical mount, with the outlet askew such that the symmetrical mount, when placed in a strategically located nozzle opening, can address bit- or bottom-balling situations by a simple reversal of the orientation where multiple orientations are available for the base. Alternatively, in the area between adjacent cones, multiple nozzle installations can be provided to independently address the bit-balling and bottom-balling situations between adjacent cones. In any given bit, individual nozzles to address bit- or bottom-balling can be mounted between different pairs of cones so as to be able to address both problems in a bit body design that only provides for a single nozzle outlet between each of the cones.

DETAILED DESCRIPTION OF THE PREFERRED EMBODIMENT

Figure 3:
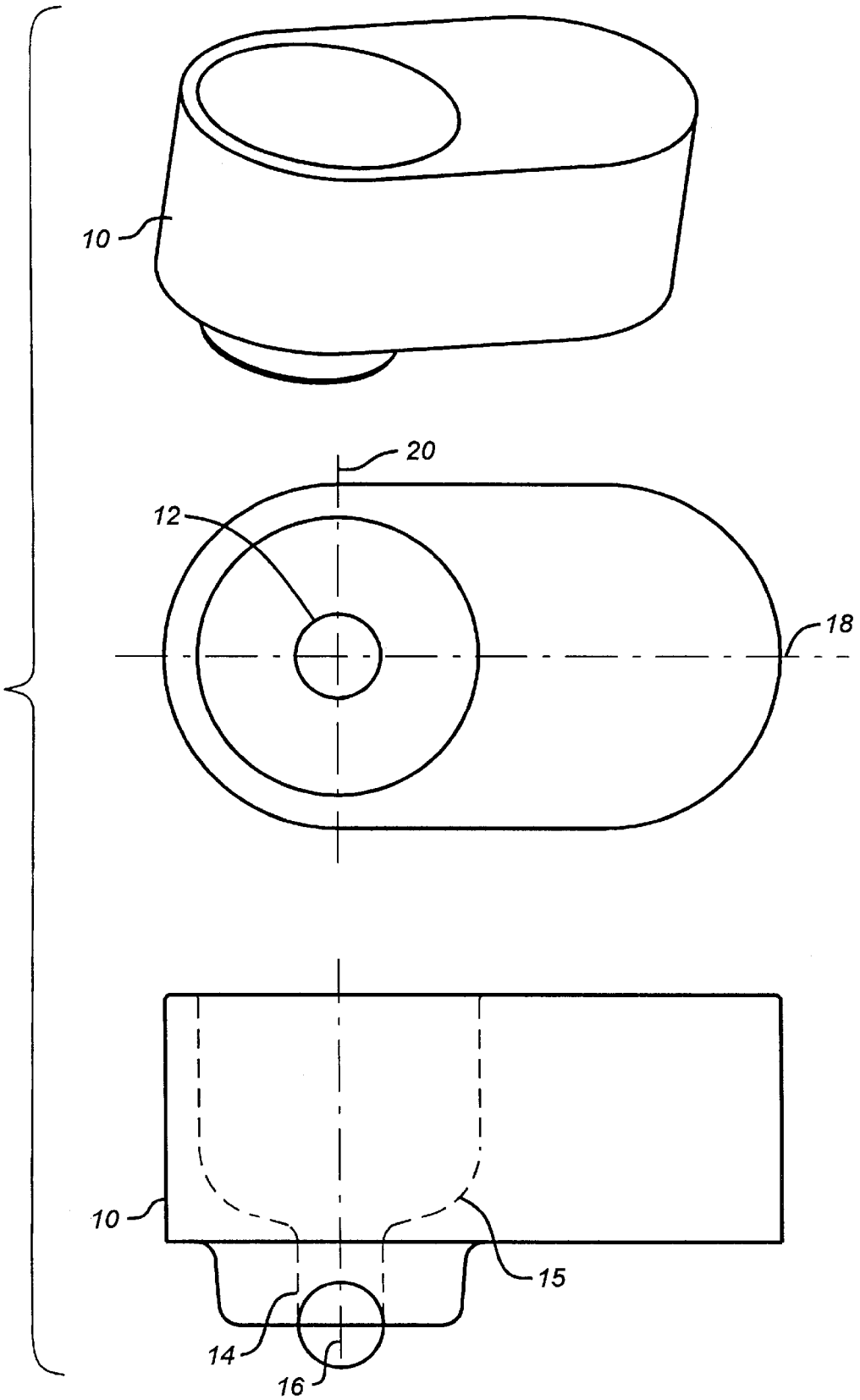
FIG. 3 represents a variety of views of an oval-based mount for a nozzle which allows shifting of the centerline of the nozzle outlet, depending on the manner in which the base is installed to the bit.

FIG. 3 illustrates an approach to allow adjustability in a bit for the conditions anticipated in drilling. In this embodiment, the nozzle body 10 has an oval shape with a nozzle outlet 12. The nozzle bore 14 has a longitudinal axis 16 which, in the preferred embodiment, is perpendicular to transverse axes 18 and 20. The body 10 can be installed into a nozzle opening of a bit body 22, shown schematically in FIG. 6.

The orientation of the bore 14 can also be askew with respect to axes 18 and 20 without departing from the spirit of the invention. The significant aspect of the embodiment illustrated in FIG. 3 is that the bore 14 Is off-center from the body 10 so that when the body 10, for example, is installed in one position as opposed to another position which is rotated 180°, the stream emerging from bore 14 is orientable at the bottom of the hole for bottom-balling situations, or near the cone for bit-balling situations. Apart from the two opposed positions, the body 10 can be secured in its opening at different depths or other angular offsets to further direct a stream from outlet 12. While an oval base or body 10 is shown, different oblong or noncylindrical shapes can be used. By using an oblong shape, the nozzle outlet 12 is brought closer to the trailing side of an adjacent cone as measured in the direction of rotation of the bit) to address bit balling and closer to its traditional spot between the legs to address bottom balling when the body 10 is rotated before installation into the bit body (not shown). By directing outlet 12 to the cone In the same bit third which is ahead of it in the direction of rotation, the distance to the cone is shortest and the cleaning more effective. Other alternatives can be a body 10 that is triangular, round or other shapes that, due to configuration, allow redirection of outlet 12 in a multiplicity of positions.

The nozzle body can be made in one piece or two. FIG. 3 shows a one-piece construction with an internal curved transition 15 leading to bore 14. Bore 14 can be in a separate piece which is rotatably mounted into nozzle body 10. If bore 14 has a skew with respect to axis 16 and/or is offset from the center of the rotatably mounted nozzle piece (not shown), then a coarse and fine adjustment is possible. The coarse adjustment is accomplished by installing nozzle body 10 in one of two positions with respect to the bit body. These positions are 180° apart in the preferred embodiment. The fine adjustment involves moving the separate piece with nozzle bore 14 with respect to nozzle body 10. Adjustment for the nozzle piece can be by rotation about axis 16 or uphole or downhole along axis 16. The passage through the nozzle piece can have an axis askew from the longitudinal axis of the nozzle piece so that rotation changes the orientation of the fluid stream. The outlet of the nozzle piece can be away from the axis of the nozzle piece so that rotating the nozzle piece changes the location of the fluid stream emerging.

Figure 2:
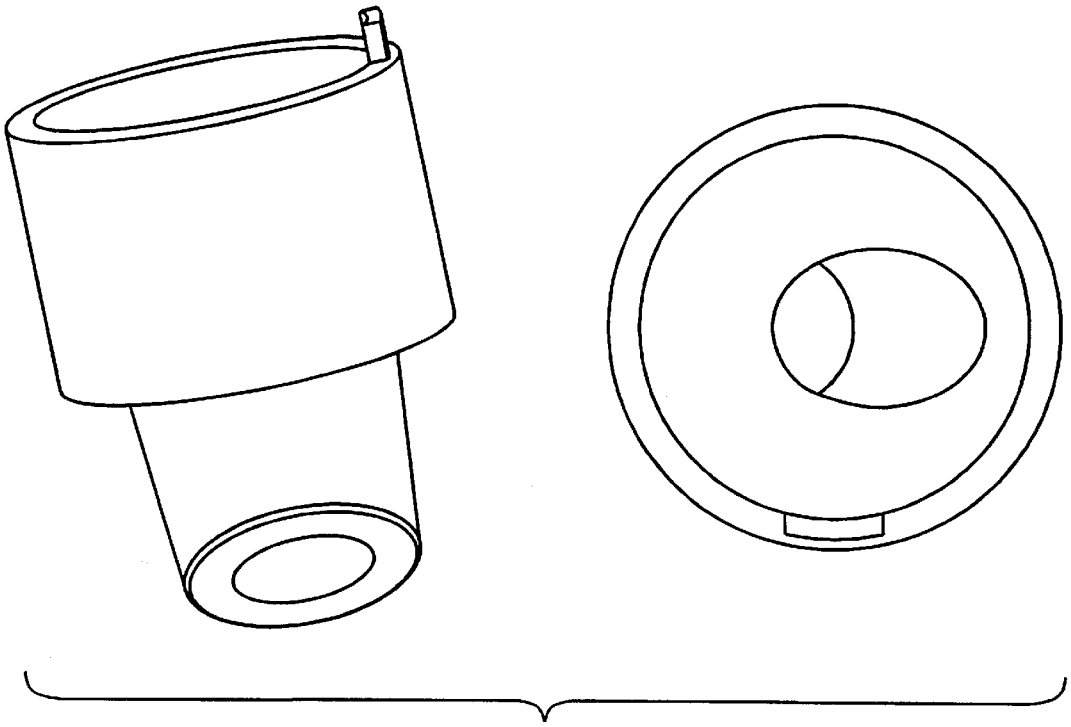
(PRIOR ART) FIG. 2
FIG. 2 is a prior art design illustrating the use of a modified standard nozzle which has a nozzle bore askew from the centerline of the base of the nozzle and forces the fluid to make a turn within the nozzle body.
Figure 7:
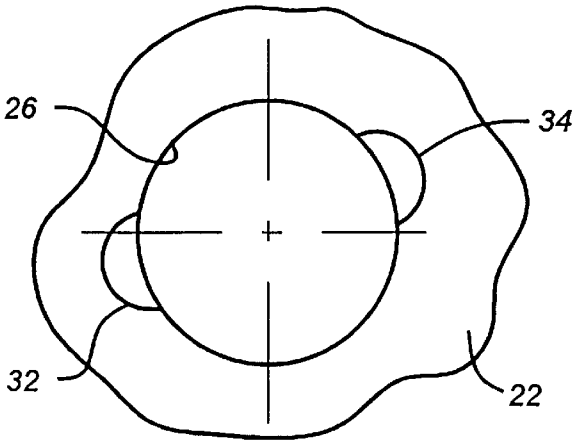
FIG. 7 is a schematic top view illustrating the receptacle into which the nozzle body of FIG. 6 can be installed, indicating two positions 180° apart.
Figure 7A:
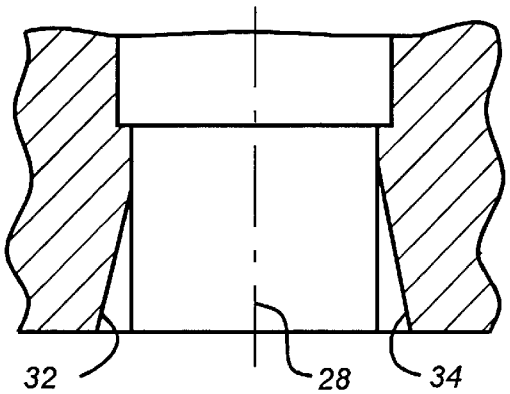
FIG. 7*a* is a sectional elevational view of FIG. 7.
Figure 6:
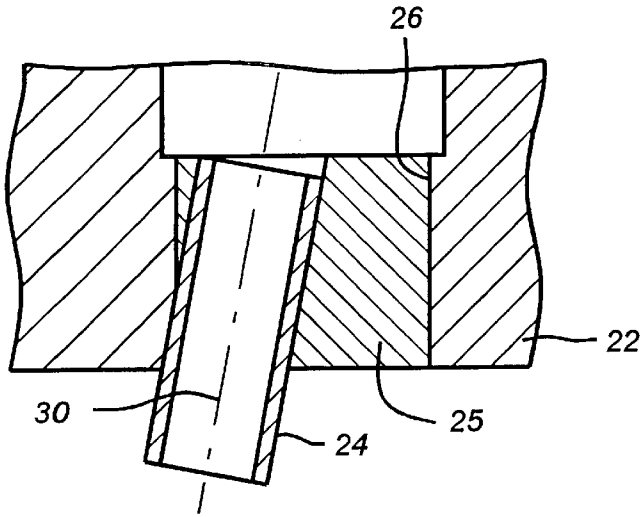
FIG. 6 is a schematic elevational view, showing a symmetrical base for a nozzle, with a tilted insert with respect to the base which can be installed in different orientations for directing the stream from the nozzle.

FIGS. 6 and 7 illustrate a variation of the design shown in FIG. 3. In FIG. 6, a carbide, or other durable material, insert sleeve 24 can be insertable in different positions in a receptacle 26 of the bit body 22. Many positions are possible depending on the nature of the attachment. The centerline of the receptacle 28 is illustrated in FIG. 6. The centerline 30 of the carbide insert sleeve 24 is illustrated in juxtaposition to centerline 28. FIG. 7 illustrates the use of guide grooves 32 and 34 which effect orientation of the carbide insert sleeve 24. Alternatively, the guide grooves or other comparable indexing devices on the bit body such as splines can engage base 25 instead of or in addition to sleeve 24. In essence, the carbide insert sleeve 24 can be installed in one of two opposed positions where the sleeve 24 is rotated 180° using guide grooves 32 and 34. With other fastening techniques such as threads, multiple orientations are possible for further adjustment of orientation of axis 30. The carbide insert sleeve 24 extends from a base 25 which is secured in the receptacle 26. In the preferred embodiment, the receptacle 26 and the base 25 are round, with the advantage being adjustability of the orientation of axis 30 and the elimination of a need to turn the fluid as it passes in the bore through the base 25 and the sleeve 24. Erosion and fluid energy losses are minimized by this layout In the preferred embodiment, the passage through base 25 and sleeve 24 has no internal turns. It is within the scope of the invention to be able to position sleeve 24 in several positions where it is shifted about axis 28 and/or translated with respect to axis 28. The significant difference in this design with the prior art tilted nozzle illustrated in FIG. 2 is that there are no turns for the fluid stream within the nozzle body. In essence, the fluid moves without turning through the nozzle body represented by the carbide insert sleeve 24. Other materials can be used for sleeve 24 without departing from the spirit of the invention. Various clamping devices can be used to secure the position of the sleeve 24 in one of two inverted orientations, being 180° apart or some other value, such as snap rings, threads, or the like. Those skilled in the art can appreciate that the mechanism by which the angular orientation of the centerline 30 is accomplished can be varied without departing from the spirit of the invention. Additionally, in a tri-cone bit which has three nozzles, each one located between two roller cones, the orientation of the arrangement shown in FIG. 6 can be varied such that all of the sleeves 24 have identical orientation, either toward the cone or the bottom of the hole, or one or two are pointed at the bottom while the other is pointed at the roller cone.

It should also be noted that with regard to the oblong base design shown in FIG. 3, the orientation of each of the nozzles on the roller cone bit need not be identical and any number of combinations of orientation among the three nozzles on the bit can be employed without departing from the spirit of the invention. Thus, for example, all of the nozzles depicted in FIG. 3 can be oriented for bottom balling or bit balling or some combination in between, addressing both issues. Additionally, the nozzle types shown in FIGS. 3 and 6 can also be employed on an individual bit without departing from the spirit of the invention. Furthermore, as previously stated, the orientation of the bore 14 leading to outlet 12 in the nozzle of FIG. 3 can be skewed with respect to axes 18 or 20.

Figure 4:
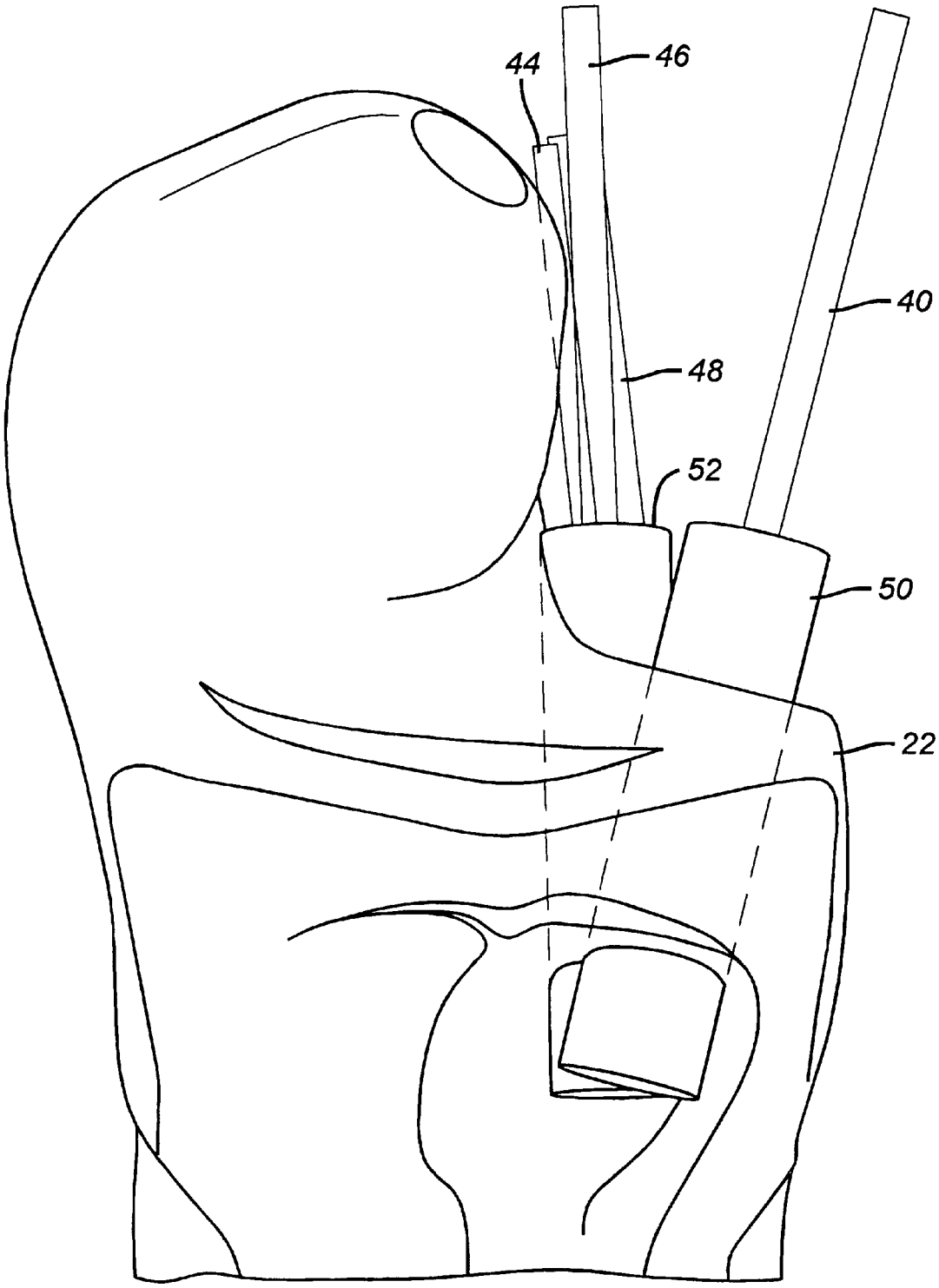
FIG. 4 is a cutaway view through a portion of the bit body, indicating schematically the use of dual nozzles between the cones and the orientation of the streams for bit balling and one stream for bottom balling.
Figure 5:
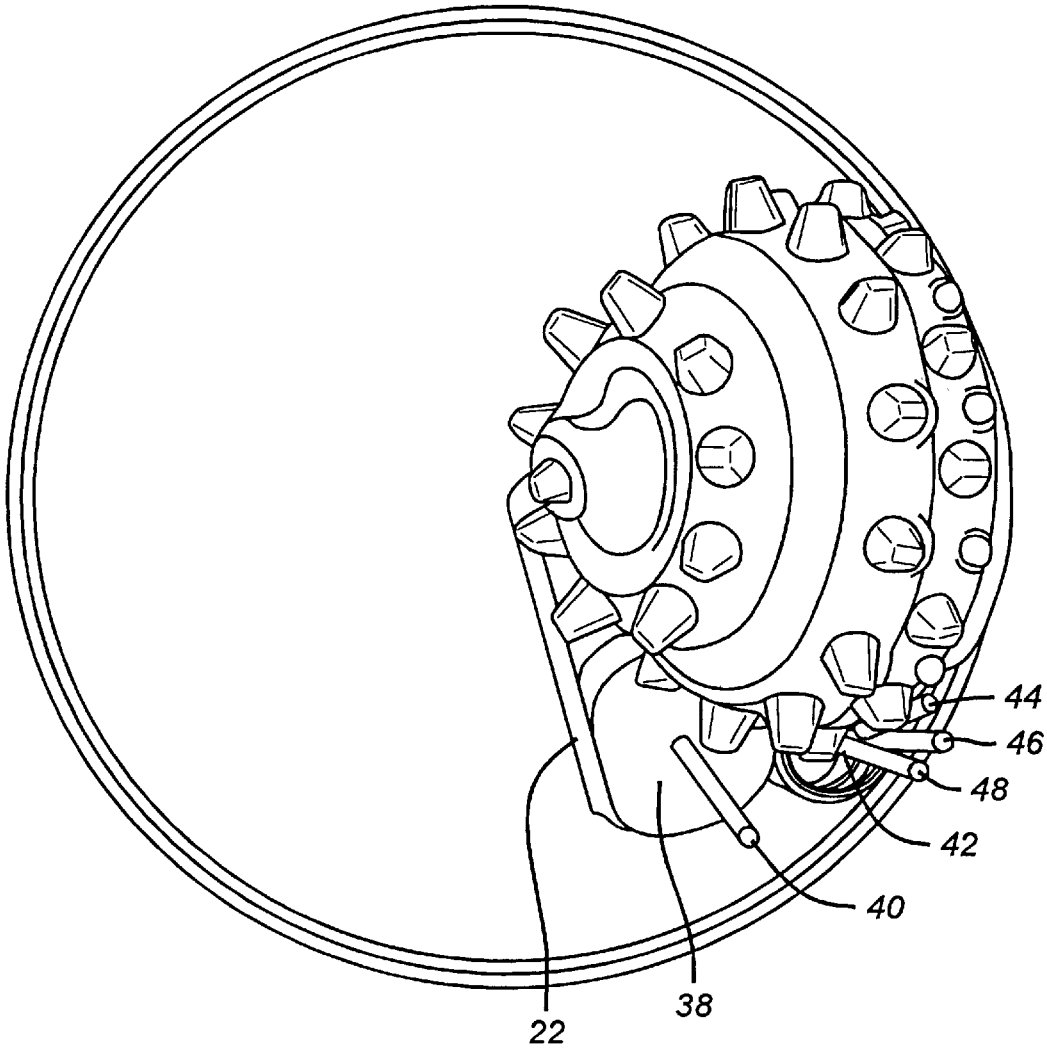
FIG. 5 is a bottom view looking up, illustrating a possibility of various streams available to address bit balling by nozzle orientation, with a single stream indicated to address bottom balling where the nozzles are mounted between the cones.
Figure 8:
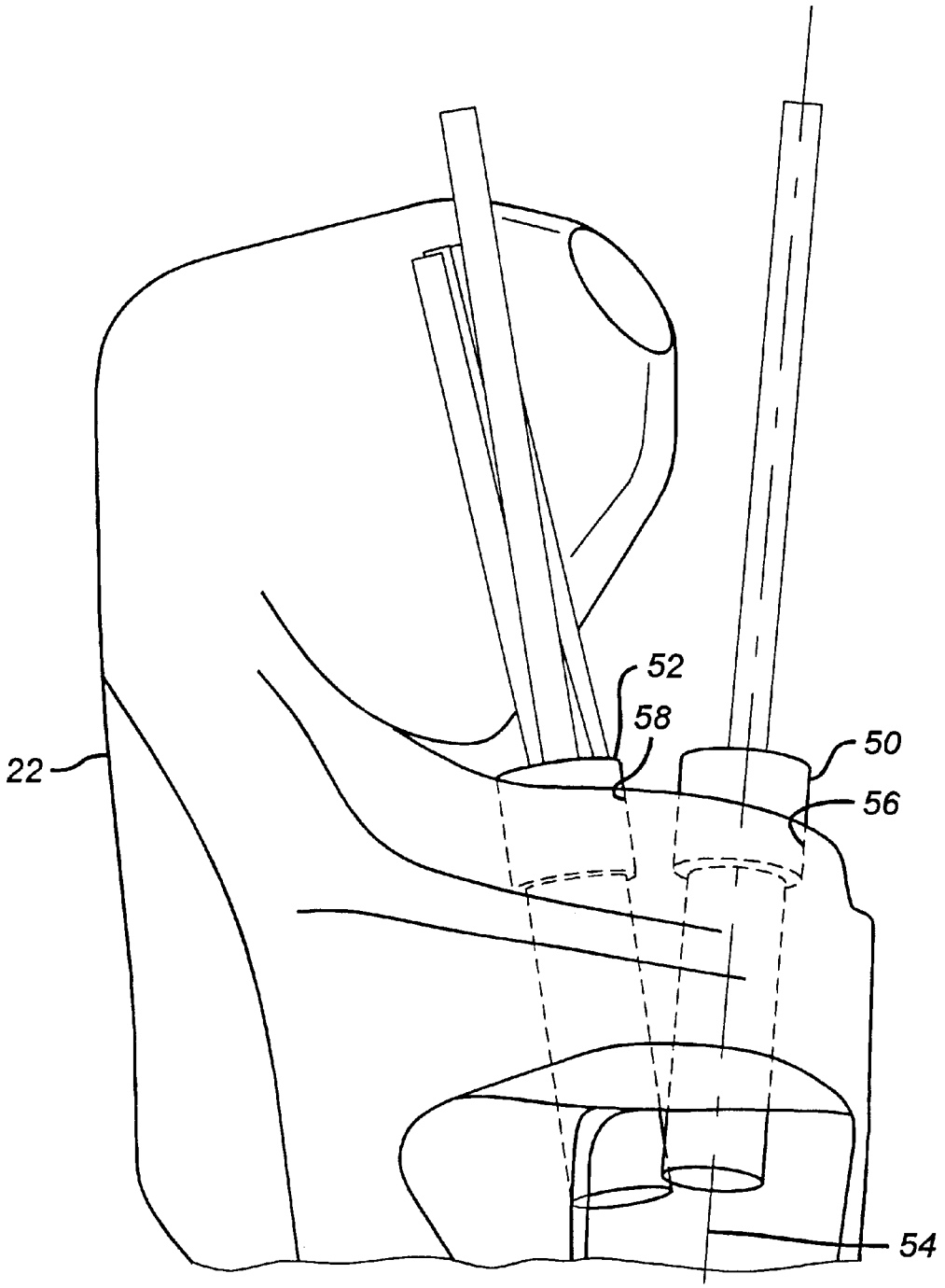
FIG. 8 is similar to FIG. 4, except that it shows the possibility of adjustability in the nozzle to address bottom balling as well as bit balling, which is addressed by a separate nozzle.

As opposed to having a single outlet in the bit body to accept a single nozzle body, as indicated in the designs shown in FIGS. 3 and 6, the bit body 22, as shown from a bottom view looking up in FIG. 5, can have an opening 38 which is oriented to accept a nozzle with a stream 40 directed at the bottom of the hole to address bottom-balling situations. The other opening 42 in the bit body 22 accepts a nozzle which, in the embodiment illustrated in FIG. 5, can have a plurality of orientation for the outlet streams such as 44,46, and 48. This opening is closer to the trailing side of an adjacent cone than opening 38, which is closer to the midpoint between adjacent legs. Putting opening 42 closer to the trailing side of the adjacent cone brings the fluid stream closer to the cone and the borehole bottom and reduces energy-dissipating turns within the nozzle to properly direct its outlet stream. This is also seen in FIG. 4 which is a schematic cutaway view of the bit body 22, which shows schematically the bottom-balling nozzle 50 with stream 40 emerging from it. Adjacent to it is nozzle 52, which is capable of multiple orientations such as 44, 46, and 48. It should be noted by comparing FIGS. 4 and 8 that the nozzle 50 can also be adjustable by a variety of techniques. The nozzle bore in nozzle 50 shown in FIG. 8 can be askew to the center-line 54 of the opening 56 in the bit body 22. Thus, depending on the installation technique for the nozzle 50, various streams can be directed at the bottom of the hole, as illustrated in FIG. 8. Alternatively, the bore in nozzle 50 can be parallel to the centerline of nozzle 50 but off-center so that the stream that emerges from nozzle 50 can be adjusted to a variety of points in a circular pattern that defines the offset of the bore in nozzle 50 from its centerline. The same options are available for nozzle 52 as nozzle 50.

Figure 1:
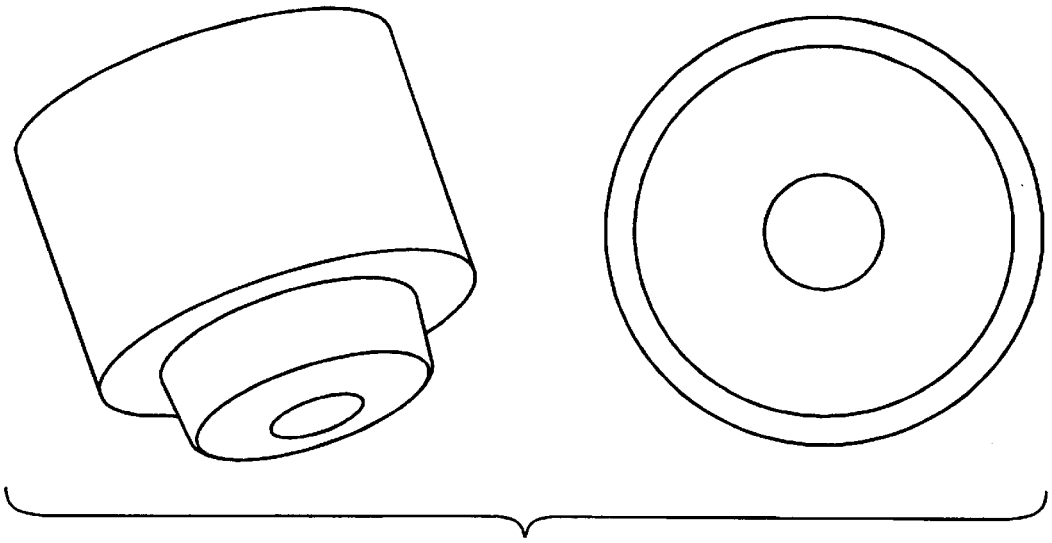
(PRIOR ART) FIG. 1
FIG. 1 is a prior art design of a standard nozzle used to address bottom-balling situations.

Alternatively, nozzles such as those illustrated in FIGS. 1, 2, or 6 can be employed in the embodiment of the bit shown in FIGS. 4 and 8 without departing from the spirit of the invention. It should also be noted that the FIGS. 4 and 8 illustrate one location between adjacent roller cones and that the situation can be repeated at the other two locations. Thus, it is within the purview of the invention to include a total of six discrete nozzle outlets, with two appearing in between each pair of roller cones and the nozzles 50 and 52 inserted in each location to address both bottom- and bit-balling issues from between every adjacent pair of roller cones. The designs of FIGS. 4 and 8 allow for flexibility to blank off one of the openings, such as 56, for example, so that in that situation, only the bit-balling situation is addressed.

It can be seen that with the provision of a pair of nozzle openings, such as 56 and 58 shown in FIG. 8, customization of a particular bit prior to use is facilitated. The opening 58, which is designed to address bit balling, can have an adjustable nozzle oriented in a variety of ways, depending on the formation to be drilled. These various nozzle stream configurations are shown in FIGS. 4 and 8 for the bit-balling situation. FIG. 8 further shows the possibility of adjustability of the outlet streams from nozzle 50 to address the bottom-balling situation. The various techniques described above to skew the centerline of the nozzle bore with respect to the nozzle body, such as, for example, FIG. 6 or FIG. 2, can be incorporated in the dual-outlet design of FIG. 8 to achieve maximum user adjustability. When using the FIG. 2 design in the FIG. 8 nozzle opening, the prior disadvantage of the added spray distance to reach the target area is reduced because the bit opening for the nozzle is moved closer to its intended target area. The energy losses in such a nozzle of FIG. 2 remain an issue. The design of FIG. 1 does not provide for adjustment of the stream orientation. The nozzle outlet can be raised or lowered with respect to the bottom of the bit, but due to its symmetrical construction, the orientation of the stream cannot be changed. It can be used interchangeably in the same location as the nozzle shown in FIG. 2.

It is also within the purview of the invention to alternate as between two adjacent roller cones a dual outlet as shown in FIGS. 4 and 5, for the purpose previously described, as well as singular outlets at other locations which can accommodate different designs of nozzles such as the oval or oblong shape illustrated schematically in FIG. 3, or the insert sleeve 24 design as shown in FIG. 6. In the designs of FIGS. 3 and 6, the positioning is optimized, while the elimination of turns within the nozzle body allows effective use of the fluid energy from the nozzle to accomplish its intended cleaning purpose, either at the roller cone or at the hole bottom.

The foregoing disclosure and description of the invention are illustrative and explanatory thereof, and various changes in the size, shape and materials, as well as in the details of the illustrated construction, may be made without departing from the spirit of the invention.

What is claimed:

1. A rotary bit for drilling a wellbore, comprising:

a bit body to receive drilling fluid under pressure, said bit body having a plurality of depending legs extending from an outer periphery of its lower end, each leg spaced from the other legs:

a plurality of roller cutters, one for each leg, comprising a generally conical cutter body rotatably mounted on the respective leg and a plurality of cutting elements on the cutter body engageable with a bottom of the wellbore;

said bit body formed having at least a first and second opening between at least one pair of said legs and located near said periphery;

said first opening positioned on said bit body in a location where it can accept a first nozzle for directing drilling fluid directly at the borehole bottom;

said second opening is positioned on said bit body in a location where it can accept a second nozzle for directing drilling fluid initially toward an adjacent roller cutter.

2. The bit of claim 1, further comprising:

a plurality of first and second openings disposed in pairs between a plurality of pairs of legs;

at least one first nozzle in at least one said first opening to direct a drilling fluid stream directly to the borehole bottom;

at least one second nozzle in at lease one said second opening to direct a drilling fluid stream initially toward an adjacent roller cutter; and a plug in any said first or second opening where no nozzle is mounted.

3. The bit of claim 1, further comprising:

a first and second opening between each pair of legs;

a first nozzle in each of said first openings and a second nozzle in each of said second openings.

4. The bit of claim 1, wherein:

said conical cutter bodies having a leading side ahead of a trailing side as determined by a direction of rotation;

said first opening is positioned on said bit body approximately midway between said legs while said second opening is closer to a trailing side of an adjacent conical cutter body as viewed in the direction of rotation of the bit.

5. A rotary bit for drilling a wellbore, comprising:

a bit body to receive drilling fluid under pressure, said bit body having a plurality of depending legs at its lower end, each leg spaced from the other legs;

a plurality of roller cutters, one for each leg, comprising a generally conical cutter body rotably mounted on the respective leg and a plurality of cutting elements on the cutter body engageable with a bottom of the wellbore;

said bit body formed having at least a first and second opening between at least one pair of said legs;

said first opening positioned on said bit body in a location where it can accept a first nozzle for directing drilling fluid directly at the borehole bottom;

said second opening is positioned on said bit body in a location where it can accept a second nozzle for directing drilling fluid initially toward an adjacent roller cutter;

a first nozzle in said first opening to direct a drilling fluid stream directly to the borehole bottom; and a plug in said second opening.

6. The bit of claim 5, further comprising:

said first nozzle is adjustable in said first opening for targeting a fluid stream therefrom to different areas of the borehole bottom.

7. A rotary bit for drilling a wellbore, comprising:

a bit body to receive drilling fluid under pressure, said bit body having a plurality of depending legs at its lower end, each leg spaced from the other legs;

a plurality of roller cutters, one for each leg, comprising a generally conical cutter body rotably mounted on the respective leg and a plurality of cutting elements on the cutter body engageable with a bottom of the wellbore;

said bit body formed having at least a first and second opening between at least one pair of said legs;

said first opening positioned on said bit body in a location where it can accept a first nozzle for directing drilling fluid directly at the borehole bottom;

said second opening is positioned on said bit body in a location where it can accept a second nozzle for directing drilling fluid initially toward an adjacent roller cutter;

a second nozzle in said second opening to direct a drilling fluid stream initially toward an adjacent roller cutter; and a plug in said first opening.

8. The bit of claim 7, further comprising:

a first and second opening between each pair of legs;

a second nozzle in each of said second openings to direct a drilling fluid stream initially toward an adjacent roller cutter and a plug in each of said first openings.

9. The bit of claim 7, further comprising:

said second nozzle is adjustable in said second opening for targeting a fluid stream therefrom on different paths toward an adjacent roller cutter.

10. The bit of claim 3, wherein:

said conical cutter bodies having a leading side ahead of a trailing side as determined by a direction of rotation;

said first opening is positioned on said bit body approximately midway between said legs while said second opening is closer to a trailing side of an adjacent conical cutter body as viewed in the direction of rotation of the bit;

whereupon when said second nozzle is installed in said second opening, the distance from an outlet on said second nozzle past said adjacent conical cutter body to the bottom of the wellbore is less than a distance to the bottom of the wellbore had such nozzle been inserted into said first opening.

11. The bit of claim 10, wherein:

said bit body has a passage leading up to said second opening, said second nozzle has a passage therethrough whereupon because of the position of said second opening with respect to said adjacent roller cutter, the turning of drilling fluid through said passage in said second nozzle is minimized to reduce fluid energy losses therein.

12. A rotary bit for drilling a wellbore, comprising:

a bit body to receive drilling fluid under pressure, said bit body having a plurality of depending legs at its lower end, each leg spaced from the other legs;

a plurality of roller cutters, one for each leg, comprising a generally conical cutter body rotably mounted on the respective leg and a plurality of cutting elements on the cutter body engageable with a bottom of the wellbore;

said bit body formed having at least a first and second opening between at least one pair of said legs;

said first opening positioned on said bit body in a location where it can accept a first nozzle for directing drilling fluid directly at the borehole bottom;

said second opening is positioned on said bit body in a location where it can accept a second nozzle for directing drilling fluid initially toward an adjacent roller cutter;

a first and second opening between each pair of legs;

a first nozzle in each of said first openings to direct a drilling fluid stream directly to the borehole bottom and a plug in each of said second openings.

13. A rotary bit for drilling a wellbore, comprising:

a bit body adapted to be detachably secured to a drill string for rotating the bit and to receive drilling fluid under pressure from the drill string, said body bit having a plurality of depending legs at its lower end, each leg spaced from the other legs;

a plurality of roller cutters, one for each leg, comprising a generally conical cutter body rotably mounted on the respective leg and a plurality of cutting elements on the cutter body engageable with a bottom of the wellbore;

said bit body formed having an opening between at least one pair of said legs;

a nozzle body mountable in said opening in a plurality of positions, said nozzle body having an outlet which, depending on the nozzle body position, can be close enough to the midpoint between said legs to clean the bottom of the wellbore or close enough to an adjacent roller cutter to clean said cutting elements.

14. The bit of claim 13, wherein:

said bit body comprises an opening between each pair of legs where each said opening further comprises an asymmetrical nozzle body so that the nozzle body outlet between each pair of legs can be directed closer to an adjacent trailing side of an adjacent cone as viewed in the direction of bit rotation or closer to the midpoint between the legs.

15. The bit of claim 14, wherein:

said opening in said bit body between each pair of legs is asymmetrical to allow said asymmetrical nozzle body, which fits into said asymmetrical bit body opening, to be installed in opposed positions rotated about 180° from each other.

16. The bit of claim 15, wherein:

all said nozzle bodies are oriented so that their outlets are closer to the midpoint between said legs.

17. The bit of claim 15, wherein:

all said nozzle bodies are oriented so that their outlets are closer to a trailing side of an adjacent roller cutter as viewed in the direction of bit rotation.

18. The bit of claim 15, wherein:

at least one of the nozzle bodies is oriented so that its outlet is closer to the midpoint between said legs and at least one of said nozzle bodies is oriented so that its outlet is closer to a trailing side of an adjacent roller cutter as viewed in the direction of rotation.

19. The bit of claim 15, wherein:

said nozzle body, in either of its two opposed mounting orientations, can be mounted in its respective opening in said bit body in different positions.

20. A bit body adapted to be detachably secured to a drill string for rotating the bit and to receive drilling fluid under pressure from the drill string, said body bit having a plurality of depending legs at its lower end, each leg spaced from the other legs;

a plurality of roller cutters, one for each leg, comprising a generally conical cutter body rotably mounted on the respective leg and a plurality of cutting elements on the cutter body engageable with a bottom of the wellbore;

said bit body formed having an opening between at least one pair of said legs;

a nozzle body mountable in said opening in a plurality of positions, said nozzle body having an outlet which, depending on the nozzle body position, can be closer to the midpoint between said legs or closer to an adjacent roller cutter;

said bit body comprises an opening between each pair of legs where each said opening further comprises an asymmetrical nozzle body so that the nozzle body outlet between each pair of legs can be directed closer to an adjacent trailing side of an adjacent cone as viewed in the direction of bit rotation or closer to the midpoint between the legs;

said opening in said bit body between each pair of legs is asymmetrical to allow said asymmetrical nozzle body, which fits into said asymmetrical bit body opening, to be installed in opposed positions rotated about 180° from each other;

said nozzle body is formed in two components, an asymmetrical base component and a separate nozzle component, so that while said base component is in either of said opposed positions, said nozzle component can be moved relatively to said base component to further direct the outlet located in the nozzle component.

21. The bit of claim 20, wherein:

said nozzle component has a longitudinal axis and said opening not coinciding with said longitudinal axis so that rotation of said nozzle component about its longitudinal axis repositions said outlet with respect to said longitudinal axis.

22. The bit of claim 20, wherein:

said nozzle component has a longitudinal axis and a passage leading to said outlet which is transverse to said longitudinal axis such that rotation of said nozzle component about its longitudinal axis angularly repositions a fluid stream emerging from said outlet.

23. The bit of claim 20, wherein:

said base component has a receptacle having a longitudinal axis which accepts said nozzle component in a plurality of positions along said longitudinal axis.

24. A rotary bit for drilling a wellbore, comprising:

a bit body adapted to be detachably secured to a drill string for rotating the bit and to receive drilling fluid under pressure from the drill string, said bit body having a plurality of depending legs at its lower end, each leg spaced from the other legs;

a plurality of roller cutters, one for each leg, comprising a generally conical cutter body rotatably mounted on the respective leg and a plurality of cutting elements on the cutter body engageable with a bottom of the wellbore;

said bit body formed having an opening between at least one pair of said legs;

a nozzle body mountable in said opening and having an extending sleeve with a passage extending through said nozzle body and said sleeve leading to an outlet;

said nozzle body having a first axis and said passage in said sleeve having a second axis disposed askew with respect to said first axis to allow repositioning of said outlet on said sleeve by rotation of said nozzle body with respect to said bit body.

25. The bit of claim 24, wherein:

said passage in said nozzle body and sleeve has no bends.

26. The bit of claim 24, further comprising:

an indexing feature operable between said nozzle body and said bit body to limit the number of rotational orientations that said nozzle body can be secured to said bit body.

27. The bit of claim 24, further comprising:

an indexing feature operable between said sleeve and said bit body to limit the number of rotational orientations that said nozzle body can be secured to said bit body.

28. The bit of claim 24, wherein:

said roller cutter having a trailing side as measured in the direction of rotation; and the location of said opening in said bit body between said pair of legs and the orientation of said passage in said nozzle body and sleeve, with respect to said first axis, allow, by virtue of rotation of said nozzle body, the selection of the orientation of a stream emerging from said outlet to go to a multiplicity of positions including either toward the bottom of the wellbore or initially toward a trailing side of an adjacent roller cutter as measured in a direction of bit rotation.

29. The bit of claim 28, wherein:

two orientations of said nozzle body 180° apart are preselected due to positioning of an indexing device on said bit body which interengages with said sleeve.

30. The bit of claim 29, wherein:

said bit body comprises opposed depressions which engage said sleeve in either of two opposed 180° orientations.

* * * * *